United States Patent [19]

Meyer

[11] 4,214,380

[45] Jul. 29, 1980

[54] DRYER EXHAUST VENT

[75] Inventor: Stephen T. Meyer, Indianapolis, Ind.

[73] Assignee: Deflecto Corporation, Indianapolis, Ind.

[21] Appl. No.: 939,459

[22] Filed: Sep. 5, 1978

[51] Int. Cl.[2] ..... F24F 13/18

[52] U.S. Cl. ..... 34/235; 98/99.1; 98/119

[58] Field of Search ..... 98/99 R, 99.1, DIG. 7, 98/119; 34/235

[56] References Cited

U.S. PATENT DOCUMENTS

| | | | |
|---|---|---|---|
| 3,204,548 | 9/1965 | McCabe | 98/119 |
| 4,081,915 | 4/1978 | Materhiak et al. | 34/235 |

*Primary Examiner*—Edward G. Favors

*Attorney, Agent, or Firm*—Woodard, Weikart, Emhardt & Naughton

[57] ABSTRACT

A dryer exhaust vent for connecting an interior clothes dryer exhaust duct to the atmosphere includes a generally square frame portion, a generally cylindrical connecting duct section integral with the frame portion and four arcuate fins which are pivotally retained in the frame portion. A central flow passageway extends from the free end of the connecting duct section through the frame portion and exits on the opposite side of the frame portion. This flow passageway permits communication between the dryer exhaust duct and the atmosphere such that hot air exhausted by electric or gas clothes dryers is released from the home or structure in which the dryer is used to the outside atmosphere. The back side of the frame portion abuts against the outer surface of the structure and the generally cylindrical connecting duct section extends through to the interior of the structure. The four arcuate fins are outwardly and upwardly movable in response to dryer exhaust pressure from a closed position, wherein the flow passageway is closed, to an opened position wherein the flow passageway is open. When the four fins are in the closed position, the fins are virtually flush with the outermost surface of the frame portion thereby providing a low profile exterior structural arrangement which does not interfere with mowing grass or trimming in areas which are adjacent the wall of the structure.

16 Claims, 11 Drawing Figures

DRYER EXHAUST VENT

BACKGROUND OF THE INVENTION

The present invention relates in general to ventilating apparata and in particular to exhaust vents associated with residential clothes dryers.

One aspect of either electric or gas clothes dryers which are commonly found in the home is that the hot air which is exhausted from such dryers must be routed to the outside atmosphere. In apartments and similar structures, this may be done by means of a duct which extends from the position site of the dryer up through the structure to a rooftop location. At this rooftop location, a vent hood or hat is used in order to prevent various forms of moisture and debris entering the duct and reaching the dryer. When a gas or electric dryer is installed in a home, a suitable escape route for the dryer exhaust is normally through a wall of the structure and the portion of the dryer exhaust duct which extends through the wall of the structure is fitted with a vent-type apparatus referred to as a "hood." This "hood" member overhangs and shields the end of the dryer exhaust duct so that various forms of moisture and debris will not enter. Typically such "hoods" include a flap-type member disposed over the outermost opening of the dryer exhaust duct and this flap-type member is free to swing back and forth through the end opening. One disadvantage with this type of design is that the exit location of the exhaust to the atmosphere is usually near ground level and the overhanging portion of the "hood" protrudes outwardly from the structure for several inches. This protruding distance typically complicates the mowing and trimming of the grass near the structure in the area of the "hood." A further disadvantage with such conventional hoods is that birds, animals and insects may use portions of the overhanging portion of the hood for nests, as a point of entry into the structure and for other activities. A still further disadvantage with such conventional hoods is that the flap, inasmuch as it is free to pivot back and forth, generates a "flutter" type of noise in response to outside wind blowing against it and moving it back and forth between the face of the corresponding outlet and the hood overhang. Another disadvantage with such conventional hood designs is that a flow restriction occurs by the geometry of the hood and the manner in which it blocks a portion of the opening of the dryer exhaust duct. Although such blockage may be several inches away, it does force the exhaust flow to be deflected rather than permitting a straight exiting flow direction. This bending creates a moderate back pressure flow restriction which must be overcome by the exiting exhaust in order to be free flowing. Consequently, although a three-inch or four-inch diameter dryer exhaust duct may be provided, the effective cross-sectional area of flow leaving the structure is actually less than this due to this flow restriction. A still further disadvantage of such hoods is the weight of the flap which must be overcome by exhaust pressure in order for the exhaust to escape. This also creates a flow restriction to the rate of discharge of the dryer exhaust.

It would therefore be an improvement to the design of such dryer exhaust vents to provide a lightweight vent wherein free flow from the full cross-sectional area of the dryer exhaust duct is permitted. It would also be an improvement to the design of such dryer exhaust vents if the "flutter" noise is eliminated while still providing means to block the entry of moisture and debris through the dryer exhaust duct. A still further improvement to the design of dryer exhaust vents would be to provide one with a low profile exterior with respect to the external surface of the structure so as not to protrude therefrom so that the trimming and mowing of grass would be simplified in that particular area. The invention disclosed herein provides each of these various improvements as will be described and discussed hereinafter.

SUMMARY OF THE INVENTION

A dryer exhaust vent for connecting an interior dryer exhaust duct to the atmosphere according to one embodiment of the present invention comprises a frame portion, a connecting duct section integral with the frame portion, the duct section including a flow passageway therethrough, the flow passageway extending through the frame portion, a plurality of louvered fin members pivotally retained within the frame portion and outwardly movable, in response to dryer exhaust, between a flow-passageway-closed position and a flow-passageway-open position.

One object of the present invention is to provide an improved dryer exhaust vent.

Related objects and advantages of the present invention will be apparent from the following description.

DESCRIPTION OF THE PREFERRED EMBODIMENT

Figure 1:
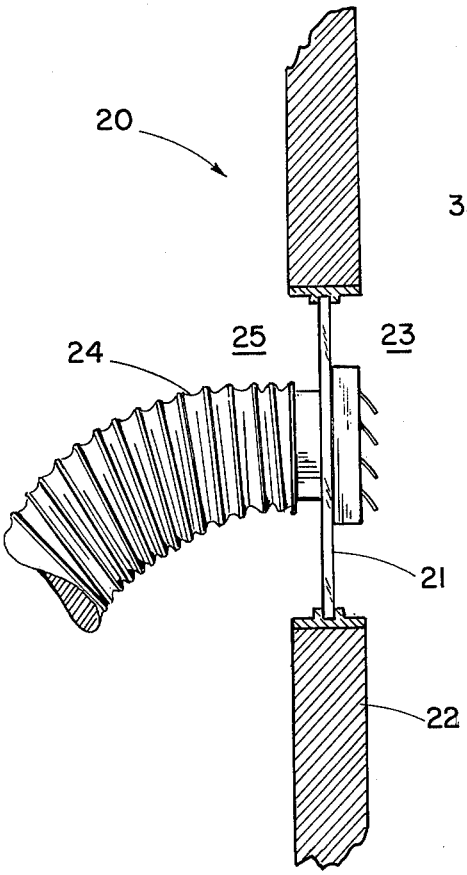
FIG. 1 is a partial, side elevation view of a dryer exhaust vent according to a typical embodiment of the present invention as installed through a window of a typical structure.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 10:
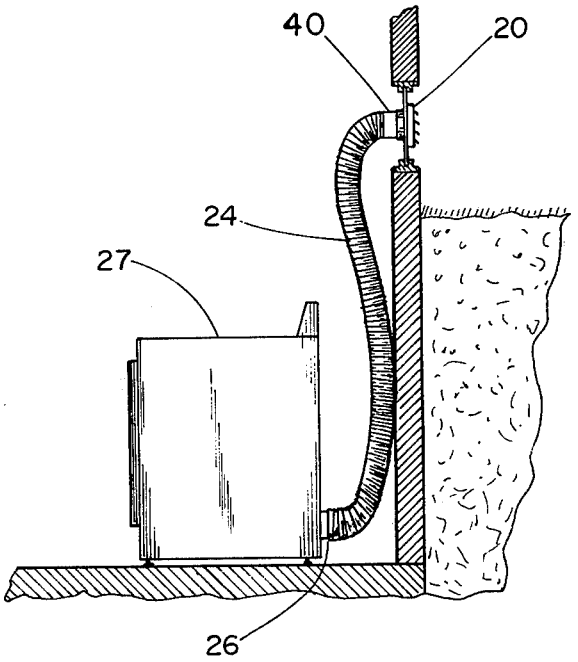
FIG. 10 is a side elevation view of the FIG. 1 dryer exhaust vent in combination with a clothes dryer and a flexible duct member.

Referring to FIG. 1, there is illustrated a dryer exhaust vent 20 which is disposed through a window portion 21 of a vertical side wall 22 of a typical structure. For example, the structure may be a home and window portion 21 may be a basement window wherein one pane has been removed and replace with a metal or wooden cover through which a generally circular hole has been provided for the insertion of dryer exhaust vent 20. Dryer exhaust vent 20 is illustrated as opening to the atmosphere 23 and is connected to a flexible dryer exhaust duct member 24 which is disposed on the interior 25 of the structure and connects at its opposite end to the exhaust port 26 of an electric or gas clothes dryer 27 as is typical with home use (see FIG. 10). In lieu of extending dryer exhaust vent 20 through a window portion 21, it is also possible to extend dryer exhaust vent 20 directly through the vertical side wall 22 of the structure. One requirement of the installation of dryer exhaust vent 20 with respect to the particular structure is that the opening through which dryer exhaust vent 20 extends be properly sized with respect to the exhaust vent so that a minimal clearance gap will have to be filled for weatherproofing purposes. A further consideration is that some means be provided for attaching dryer exhaust vent 20 to the window panel, the vertical side wall or the structural member through which vent 20 protrudes.

Figure 2:
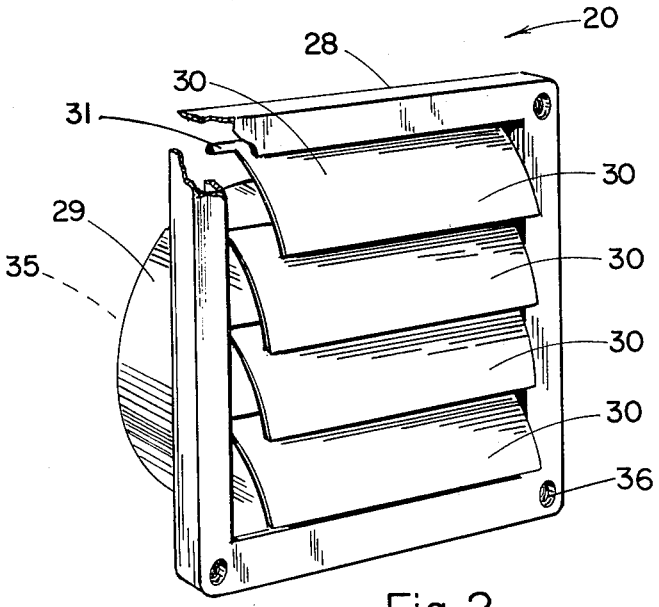
FIG. 2 is a perspective view of the FIG. 1 dryer exhaust vent in an open position.
Figure 4:
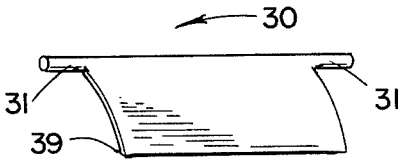
FIG. 4 is a perspective view of a louvered fin member comprising a portion of the FIG. 1 dryer exhaust vent.

Dryer exhaust vent 20 is shown in greater detail by FIG. 2. Dryer exhaust vent 20 includes frame portion 28, a generally cylindrical connecting duct section 29 which is integral with frame portion 28 and a series of louvered fin members 30 of which there are four in the illustrated embodiment. Each louvered fin member 30 has an arcuate lateral cross section and the concave side of each member 30 faces interior 25 while the convex side faces atmosphere 23. Each louvered fin member 30 includes a top edge which is substantially coincident with the pivoting axis of the fin member, two side edges and a lower edge which pivots outwardly. Lourvered fin members 30 have outwardly extending stem portions 31 (see FIG. 4) on each side along the top edge. These stem portions are received in corresponding fin member retaining recesses 32 (see FIG. 6) which are disposed in two, aligned and evenly spaced series, one series on each side of frame portion 28. With the exception of louvered fin members 30, frame portion 28 is entirely open through its inner part and connecting duct section 29 includes a flow passageway 35 therethrough which extends into and through frame portion 28. It can be seen then that by coupling flexible dryer exhaust duct member 24 to the free end of connecting duct section 29 exhaust from the dryer will pass through flow passageway 35 and correspondingly through dryer exhaust vent 20 and will be exhausted to the atmosphere 23.

Louvered fin members 30 and their corresponding stem portions 31 are freely disposed within recesses 32 such that in response to outwardly flowing exhaust pressure, these fin members 30 automatically pivot outwardly and upwardly into atmosphere 23. When there is no exhaust present in flexible dryer exhaust duct member 24, the louvered fin members 30 will collapse to a closed position wherein they close off flow passageway 35. When in this closed position, louvered fin members 30 are arranged relative to one another such that adjacent fin members overlap each other. Due to the fact that louvered fin members 30 are of significantly light weight and are freely pivotal with respect to frame portion 28, even a moderate level of exhaust pressure will cause the various louvered fin members to pivot upwardly and outwardly thereby providing an unrestricted exhaust escape route from duct member 24. If greater dryer exhaust pressures are created, then louvered fin members 30 will pivot outwardly and upwardly to a greater extent whereby a larger exhaust escape opening is created by the finned members in this opened position.

Figure 3:
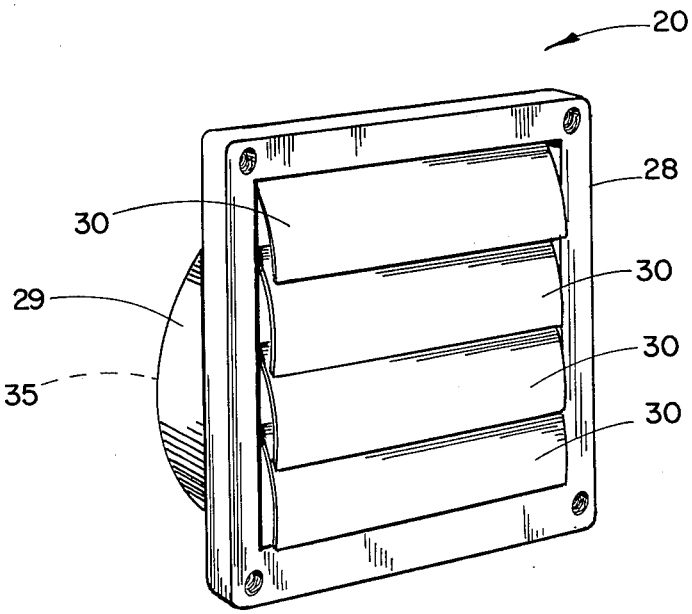
FIG. 3 is a perspective view of the FIG. 1 dryer exhaust vent in a partially closed position.

FIG. 3 illustrates the arrangement of louvered fin members 30 with respect to dryer exhaust vent 20 when these fin members are in a partially closed position as they pivot back into the surrounding confines of frame portion 28. As is illustrated, these fin members will lie substantially flush with the atmosphere-facing side of the dryer exhaust vent 20 and will thereby provide a very low profile structural arrangement. In the partially closed position of FIG. 3, as well as in the fully closed position, the only portion of dryer exhaust vent 20 which extends beyond the vertical side wall of the particular structure is the frame portion and this is approximately one-half inch in thickness. Due to the fact that there is no overhanging portion as with conventional dryer exhaust vent hoods, there is no area suitable for birds, animals, or insects to make nests. Moisture and debris are prevented from either blowing or flowing into dryer exhaust vent 20 by the fact that each of the various louvered fin members 30 are arcuate in lateral cross section with their convex outer surfaces facing outwardly and upwardly.

Figure 8:
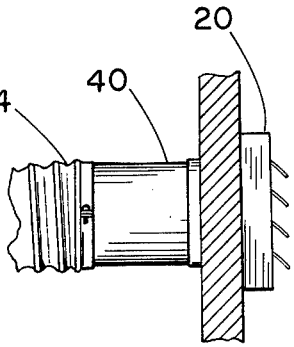
FIG. 8 is a partial, side elevation view of an alternative connection for the FIG. 1 dryer exhaust vent.
Figure 5:
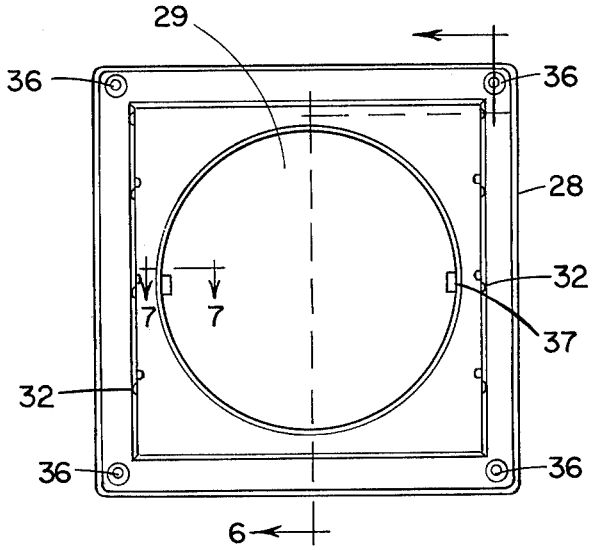
FIG. 5 is a front elevation view of a frame portion and connected duct section comprising a portion of the FIG. 1 dryer exhaust vent.
Figure 6:
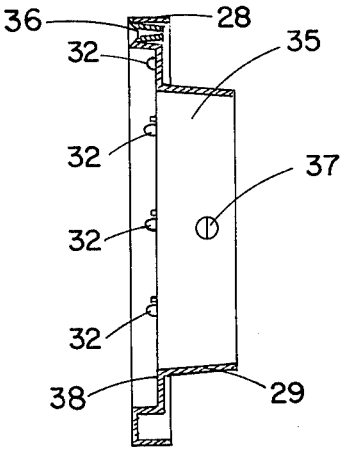
FIG. 6 is a sectioned, side elevation view of the FIG. 5 frame portion and connected duct section as taken along line 6—6 in FIG. 5.
Figure 7:
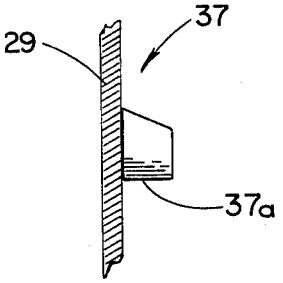
FIG. 7 is a partial plan view of a tapered tab comprising a portion of the FIG. 5 frame portion and connected duct section as taken along line 7—7 in FIG. 5.

Referring to FIG. 5, the relative size of connecting duct section 29 with respect to frame portion 28 is illustrated. Also included as part of frame portion 28 are four mounting holes 36 which are disposed in the four corners of frame portion 28. In certain structural arrangements, it may be desirable to use these four mounting holes with either conventional nuts and bolts or with sheet metal screws or wood screws. An alternative arrangement of securing dryer exhaust vent 20 to the particular structure is to utilize an adhesive or caulking compound around frame portion 28 or alternatively around connecting duct section 29 between this duct section and the portion of the structure through which the duct section extends. On the inside surface of connecting duct section 29 disposed approximately 180° apart are two tapered tabs 37 which appear to be of circular shape in one plane while projecting as a wedge shape in another plane of view. These tapered tabs provide means by which an intermediate length of pipe 40 (see FIG. 8) may be snapped into connecting duct section 29. Then the dryer exhaust duct 24 is secured to the free end of the pipe 40 by means of tape or circular clamps. Pipe 40 is provided with two recesses corresponding in size and shape to fit over tapered tabs 37 such that the dryer exhaust duct will be rigidly held in communication with connecting duct section 29. Tabs 37 are tapered in the direction of duct insertion to facilitate this step while having a curved surface 37*a* normal to the direction of insertion to lock the duct in place. The length of pipe 40 is governed by the structural arrangement through which duct section 29 extends as well as the interior clearance for connecting duct 24. The two tapered tabs 37 are illustrated in FIG. 5 while FIG. 6 shows one tapered tab in its circular plane. FIG. 7 further illustrates tapered tab 37 in its planar view which shows tab 37 as a wedge-shaped protrusion.

Figure 9:
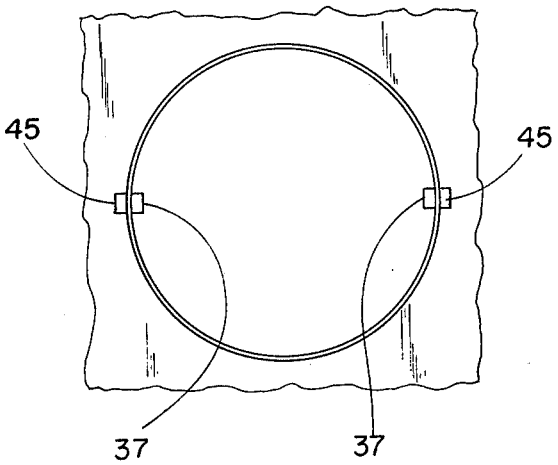
FIGS. 9 and 9A are a partial rear elevation view and a side elevation view, respectively, of an alternative connected duct section design.
Figure 9A:
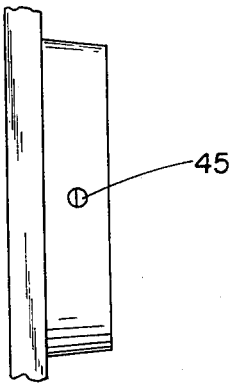

Equally a part of this invention is the providing of tapered tabs 45 on the outside of connecting duct section 29 (see FIGS. 9 and 9A). Tapered tabs 45 are of virtually the same size and arrangement as tabs 37 such that pipe 40 may be installed by being snapped over tabes 45 on the outside of section 29 or alternatively by being snapped over tabs 37 on the inside of section 29. The two recesses in pipe 40 being suitable for either attachment arrangement, and in the preferred embodiment duct section 29 is provided with both tabs 37 and 45 so that only a single exhaust vent design is necessary. Another feature of this invention is to provide pipe 40 in a variety of different lengths such that regardless of the specific structural arrangement of the particular installation site a suitable vent to dryer connection can be achieved.

A further feature of dryer exhaust vent 20 is the providing of stop means by means of the arcuate shape of the louvered fin members so that in response to wind from the atmosphere, the louvered fin members 30 will not flap back and forth between frame portion 28 and connecting duct section 29. As these louvered fin members close into their closed position wherein they are virtually flush with the outwardly facing surface of frame portion 28, the lower edge 39 (see FIG. 4) of the lowermost louvered fin member will contact the lower inside edge 38 of duct section 29 which thus acts as a stop. Thereafter the fin which is directly above the lowermost fin contacts the outer convex surface of the lowermost fin in an overlapping manner. The remaining two fins also overlap their corresponding adjacent fin in a similar way such that all fins have stop means to prevent further inward pivotal movement. By providing such stop means to the continued pivotal motion of the various louvered fin members, fluttering of the fin members will not occur and dryer exhaust vent 20 will operate in a very quiet as well as efficient manner. It is preferred that frame portion 28 and connecting duct section 29 be fabricated as a single piece out of a material such as high-impact polystyrene or other suitable thermoforming or thermosetting plastic compounds. In order to enhance the quiet operation of dryer exhaust vent 20, it is preferred that the various louvered fin members be fabricated of soft plastic, rubber or alternatively have a rubberized coating applied to their external surfaces. This soft plastic, rubber or rubberized coating has a relatively low durometer hardness level so that it remains soft and somewhat pliable over a fairly wide range of temperatures. This permits the various fin members in their overlapping louvered arrangement to move against one another into their closed position in a quiet manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A clothes dryer exhaust vent for connecting an interior dryer exhaust duct to the atmosphere said dryer exhaust vent comprising:

a frame portion;

a connecting duct section integral with said frame portion, said duct section including a flow passageway therethrough, said flow passageway extending through said frame portion;

a plurality of tapered tab members integral with said connecting duct section and of a suitable size and configuration for snapping into corresponding recess portions of an adjoining duct section; and a plurality of louvered fin members pivotally retained within said frame portion and outwardly movable, in response to dryer exhaust, between a flow-passageway-closed position and a flow-passageway-open position, each one of said plurality of fin members having two side edges, an upper pivot axis edge and a lower pivoting edge, each of said fin members further including two oppositely disposed pivot stems in longitudinal alignment with said upper pivot axis edge and extending beyond said side edges, said pivot stems extending into said frame portion.

2. The dryer exhaust vent of claim 1 wherein said plurality of louvered fin members are substantially flush with said frame portion in said flow-passageway-closed position.

3. The dryer exhaust vent of claim 1 wherein each of said plurality of louvered fin members being arcuate in lateral cross section.

4. the dryer exhaust vent of claim 3 wherein each of said plurality of louvered fin members having an exterior surface of a soft plastic compound.

5. The dryer exhaust vent of claim 2 which further includes stop means integral with said frame portion and arranged in cooperation with said plurality of louvered fin members for preventing movement of said plurality of fin members in a direction away from said flow-passageway-open position inwardly, to a point beyond said flow-passageway-closed position.

6. The dryer exhaust vent of claim 5 wherein each of said plurality of louvered fin members being arcuate in lateral cross section.

7. The dryer exhaust vent of claim 6 wherein each of said plurality of louvered fin members having an exterior surface of a rubber compound.

8. The dryer exhaust vent of claim 7 wherein said frame portion and said connecting duct section are of a single piece, molded plastic construction.

9. The dryer exhaust vent of claim 8 wherein said frame portion includes a first series of evenly spaced, fin member-retaining recesses disposed along one side of said frame portion, and a second series of fin member-retaining recesses aligned with said first series and disposed along a side of said frame portion opposite to said one side.

10. The dryer exhaust vent of claim 9 wherein adjacent ones of said plurality of louvered fin members being arranged in an overlapping relationship to each other when in said flow-passageway-closed position.

11. A clothes dryer exhaust vent assembly for connecting an interior dryer exhaust duct to the atmosphere, said assembly comprising:

a louvered outlet including a plurality of single-piece, movable louvered fin members pivotally disposed therein;

a duct section rigidly joined to said louvered outlet and being arranged in flow cmmunication therewith, said duct section having integral therewith a plurality of tapered tab members; and a removable section of pipe having a plurality of recesses therein, said recesses and tapered tabs being suitably sized and arranged to be compatible with each other in a direct, snapped-together manner for attachment of said section of pipe to said duct section without the need to turn either member.

12. The dryer exhaust vent assembly of claim 11 wherein each of said louvered fin members includes two oppositely disposed pivot stems disposed along a top edge, said fin members being outwardly movable, in response to dryer exhaust, between a closed position and a fully opened position.

13. The dryer exhaust vent assembly of claim 12 wherein said louvered outlet being surrounded by a frame portion, said louvered fin members being flush to recessed with respect to the outermost surface of said frame portion when in said closed position.

14. In combination:

a clothes dryer;

a flexible exhaust duct connected at one end to said clothes dryer;

a pipe section joined at one end to the other end of said flexible exhaust duct; and a clothes dryer exhaust vent connected to the other end of said pipe section which comprises:

a frame portion;

a connecting duct section integral with said frame portion, said duct section including a flow passageway therethrough, said flow passageway extending through said frame portion, said duct section further including integral therewith a plurality of tapered tab members, said tab members being suitably sized and arranged to snap into corresponding recessed portions of said pipe section; and a plurality of single-piece louvered fin members pivotally retained within said frame portion and outwardly movable, in response to dryer exhaust, between a flow-passageway-closed position and a flow-passageway-open position, each one of said plurality of fin members including two oppositely disposed pivot stems which extend into said frame portion.

15. The combination of claim 14 wherein said plurality of louvered fin members are substantially flush with said frame portion in said flow-passageway-closed position.

16. A clothes dryer exhaust vent for connecting an interior dryer exhaust duct to the atmosphere, said dryer exhaust vent comprising:

a frame portion;

a connecting duct section integral with said frame portion, said duct section including a flow passageway therethrough, said flow passageway extending through said frame portion;

a plurality of tapered tab members integral with said connecting duct section and being of a suitable size and configuration for directly snapping into corresponding recess portions of an adjoining duct section; and a plurality of louvered fin members pivotally retained within said frame portion and outwardly movable, in response to dryer exhaust, between a flow-passageway-closed position and a flow-passageway-open position, each of said plurality of louvered fin members further including two, oppositely disposed, outwardly extending pivot stems disposed along a top edge of said fin member and extending into said frame portion.

* * * * *